US007231966B2

(12) United States Patent
Katoh et al.

(10) Patent No.: US 7,231,966 B2
(45) Date of Patent: Jun. 19, 2007

(54) EVAPORATOR FOR REFRIGERATING CYCLE

(75) Inventors: Yoshiki Katoh, Chita-gun (JP); Masaaki Kawakubo, Obu (JP); Etsuo Hasegawa, Nagoya (JP)

(73) Assignee: DENSO Corporation, Kariya (JP)

( * ) Notice: Subject to any disclaimer, the term of this patent is extended or adjusted under 35 U.S.C. 154(b) by 15 days.

(21) Appl. No.: 11/093,153

(22) Filed: Mar. 29, 2005

(65) Prior Publication Data

US 2005/0217838 A1 Oct. 6, 2005

(30) Foreign Application Priority Data

Mar. 30, 2004 (JP) ..... 2004-100176

(51) Int. Cl.
*F28F 9/02* (2006.01)

(52) U.S. Cl. ..... 165/176; 165/153

(58) Field of Classification Search ..... 165/173–176, 165/148, 149, 152, 153
See application file for complete search history.

(56) References Cited

U.S. PATENT DOCUMENTS 5,934,367 A * 8/1999 Shimmura et al. ..... 165/174
6,339,937 B1 1/2002 Makihara et al.
6,564,863 B1 5/2003 Martins
2003/0155109 A1 8/2003 Kawakubo et al.
2004/0016535 A1* 1/2004 Shimanuki et al. ..... 165/172

FOREIGN PATENT DOCUMENTS

JP 3-043050 3/2000
JP 2001-012821 1/2001
JP 2002-213840 7/2002

* cited by examiner

*Primary Examiner*—Teresa J. Walberg
(74) *Attorney, Agent, or Firm*—Harness, Dickey & Pierce, PLC

(57) ABSTRACT

An evaporator for an air conditioning apparatus has an upper and a lower tanks and multiple tubes vertically extending and respectively connected to the tanks at upper and lower ends. A fluid passage portion is formed in the lower tank. Multiple drainage recesses are formed in the lower tank at such portions, at which the recesses do not interfere with the fluid passage portion.

19 Claims, 13 Drawing Sheets

EVAPORATOR FOR REFRIGERATING CYCLE

CROSS REFERENCE TO RELATED APPLICATION

This application is based on Japanese Patent Application No. 2004-100176 filed on Mar. 30, 2004, the disclosure of which is incorporated herein by reference.

FIELD OF THE INVENTION

The present invention relates to an evaporator for evaporating refrigerant in a refrigerating cycle, in particular to an evaporator to be used for an air conditioning apparatus for a motor vehicle.

BACKGROUND OF THE INVENTION

A heat exchanger, for example as disclosed in Japanese Patent Publication No. 2003-314987, is known in the art, in which refrigerant is heat exchanged with air. The heat exchanger comprises a core portion having multiple tubes and a pair of tanks (header tanks) fixed to the tubes, wherein the tubes and the tanks are made of separate units and both end portions of the tubes are inserted into the tanks so that passages formed in the tubes are communicated with insides of the tanks.

A width of the tank (a width in an air flow direction) must be made larger than a width of the tubes, because both ends of the tubes are inserted into and fixed to the tanks.

A fluid passage portion is formed in the tanks and a width of the fluid passage portion (in the air flow direction) is made smaller than the width of the tubes, to make the evaporator smaller in its size.

In the case that the multiple tubes are arranged to vertically extend, the tanks are respectively located horizontally at vertical ends of the core portion (at upper and lower ends of the tubes).

When refrigerant is evaporated in the evaporator by absorbing heat from air passing through outside surfaces of the tubes of the core portion, condensed water is generated at the core portion, flows down along the tubes and reaches at an upper surface of the lower tank.

In the conventional evaporator, the condensed water can not be easily drained out from the evaporator, when the lower tank has a larger width in an air flow direction than the width of the tubes. And the condensed water is likely to stay at a lower part of the core portion.

SUMMARY OF THE INVENTION

It is, therefore, an object of the present invention, in view of the above mentioned problems, to provide an evaporator for an air conditioning apparatus, in which condensed water can be easily and surely drained out from the evaporator, even when tubes and tanks are made of separate parts and the tubes are arranged to vertically extend.

According to a feature of the present invention, an evaporator has an upper and a lower tanks, a core portion having multiple vertically extending tubes, vertical ends of which are respectively fixed to the tanks, wherein a width of the lower tank is larger than a width of the tubes in an air flow direction (a direction perpendicular to a plane formed by the core portion). A fluid passage portion is formed in the lower tank, a width of which is smaller than that of the tubes in the air flow direction. Multiple drainage recesses or drainage holes are formed in the lower tank at such portions, at which the drainage recesses or holes do not interfere with the fluid passage portion, wherein drainage passages formed by the recesses or holes vertically pass through.

According to another feature of the present invention, an evaporator has an upper and a lower tanks, a core portion having two groups of multiple vertically extending tubes, wherein the multiple tubes in each group are arranged in a line at almost equal intervals, and the vertical ends of the tubes are respectively fixed to the tanks. Multiple fluid passage portions are formed in the lower tank, so that fluid passages of the tubes of one group are respectively communicated with fluid passages of the tubes of the other group. Multiple drainage recesses or drainage holes are formed in the lower tank at such portions, at which the drainage recesses or holes do not interfere with the fluid passage portions, wherein drainage passages formed by the recesses or holes vertically pass through.

According to a further feature of the present invention, the drainage recesses or holes are formed in the lower tank between the neighboring tubes.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENTS

First Embodiment

Figure 1:
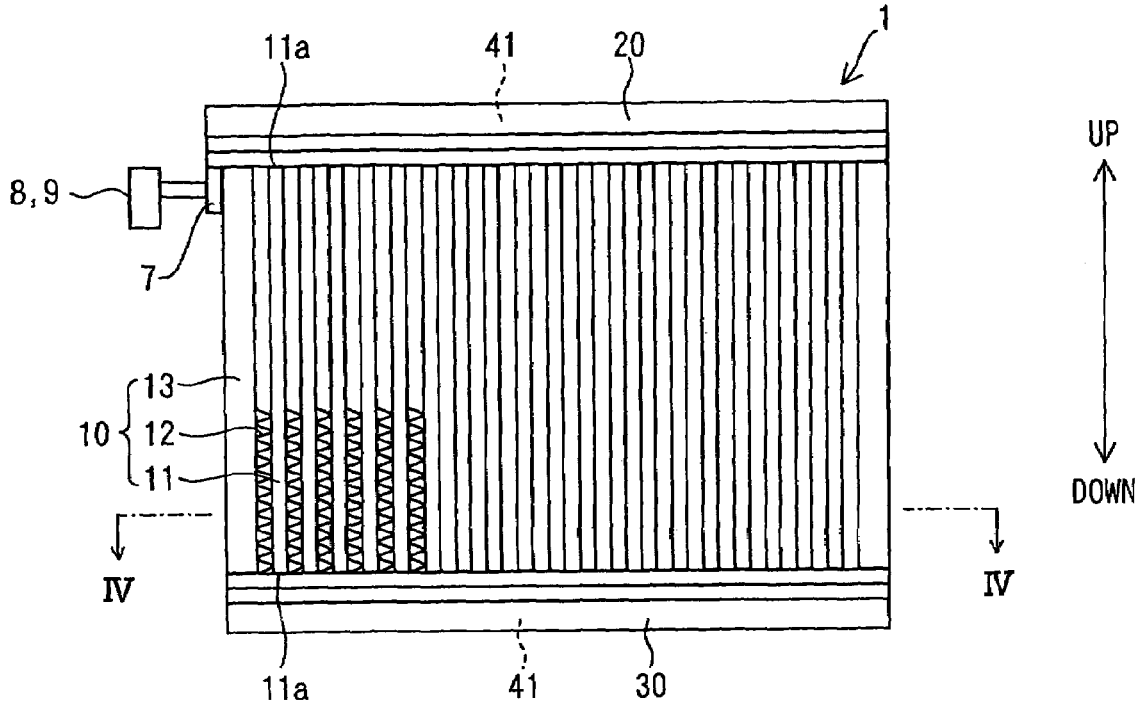
FIG. 1 is a front view schematically showing an evaporator according to a first embodiment of the present invention.

The present invention is explained with reference to embodiments shown in the drawings.

Figure 2:
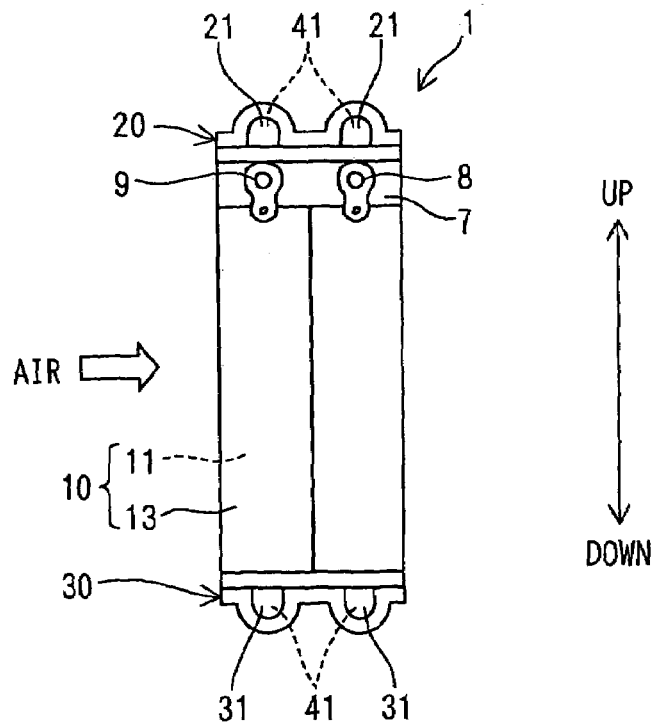
FIG. 2 is a side view of the evaporator shown in FIG. 1.
Figure 3:
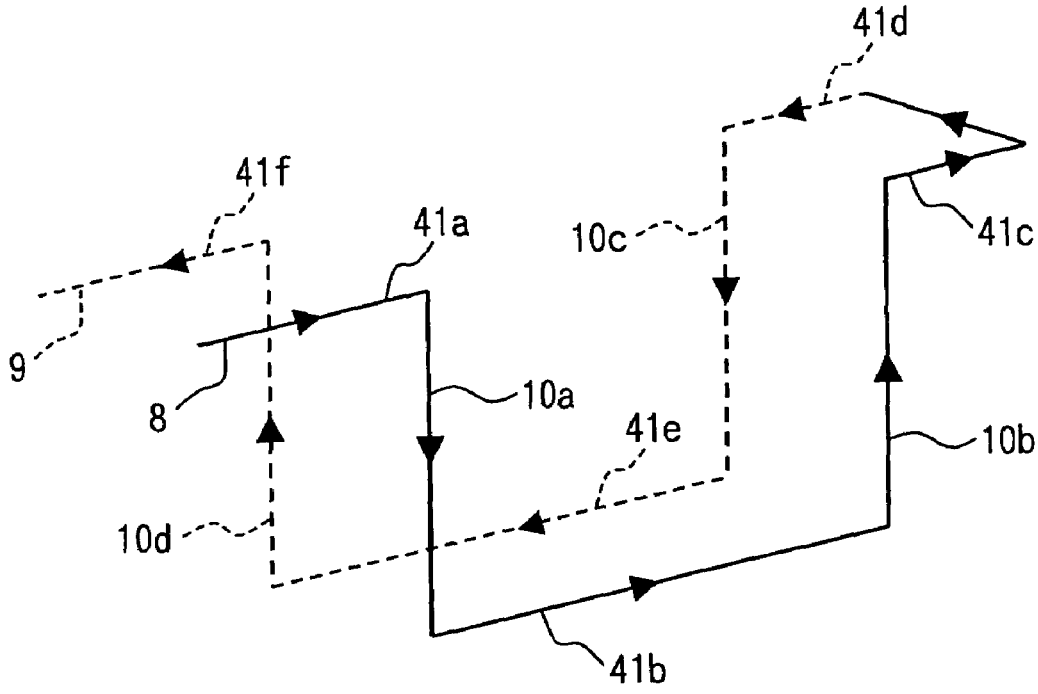
FIG. 3 is a schematic view showing a refrigerant flow in the evaporator shown in FIG. 1.
Figure 4:
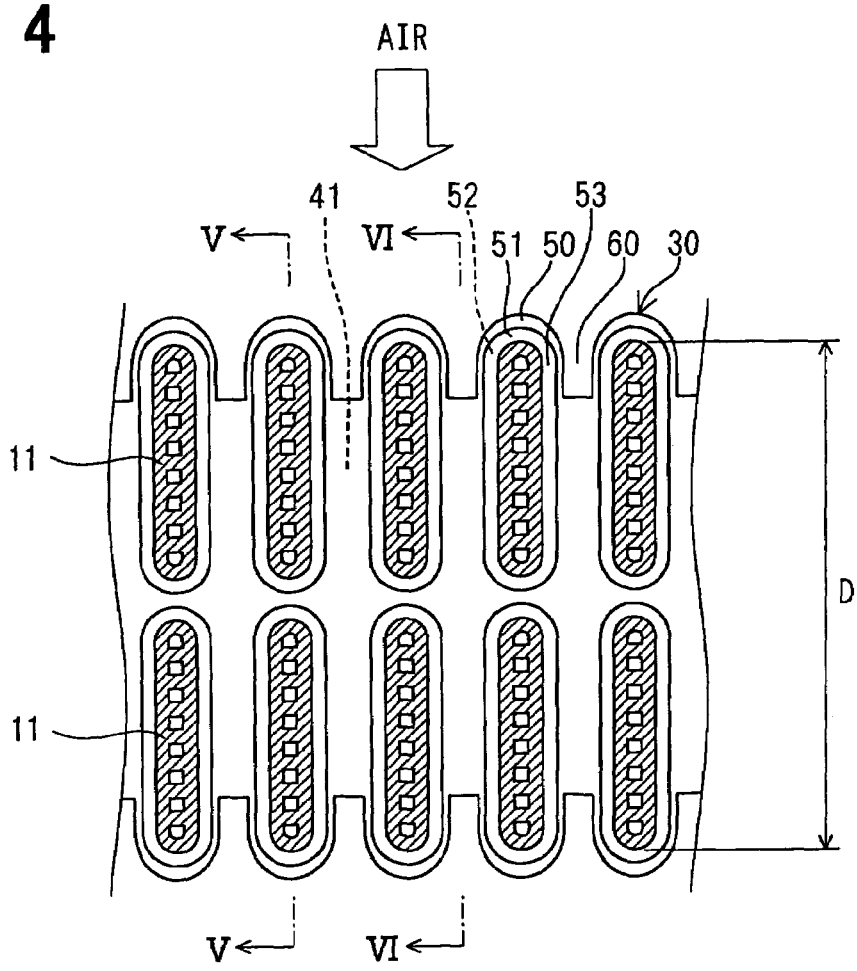
FIG. 4 is an enlarged cross sectional view taken along a line III—III in FIG. 1.
Figure 5:
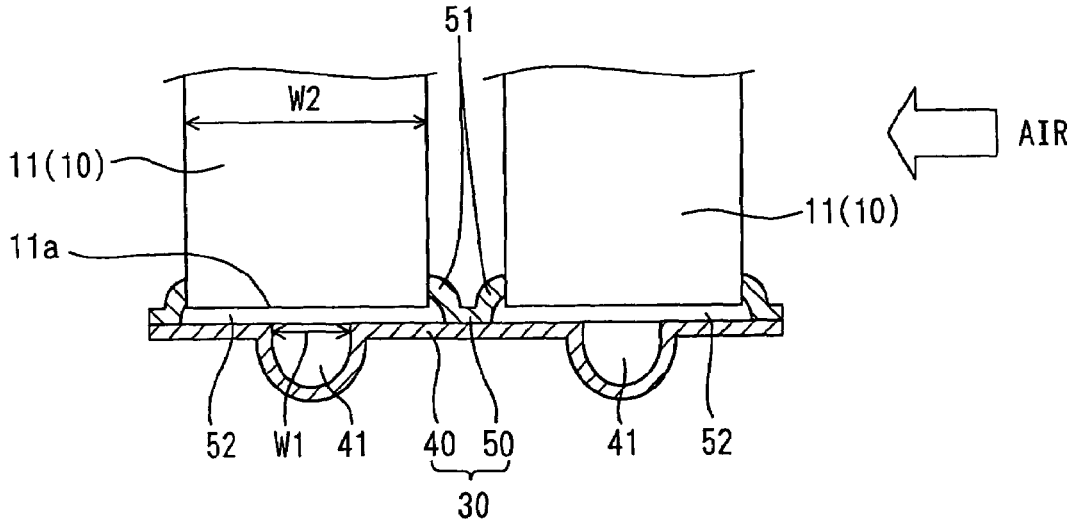
FIG. 5 is an enlarged cross sectional view taken along a line V—V in FIG. 4.
Figure 6:
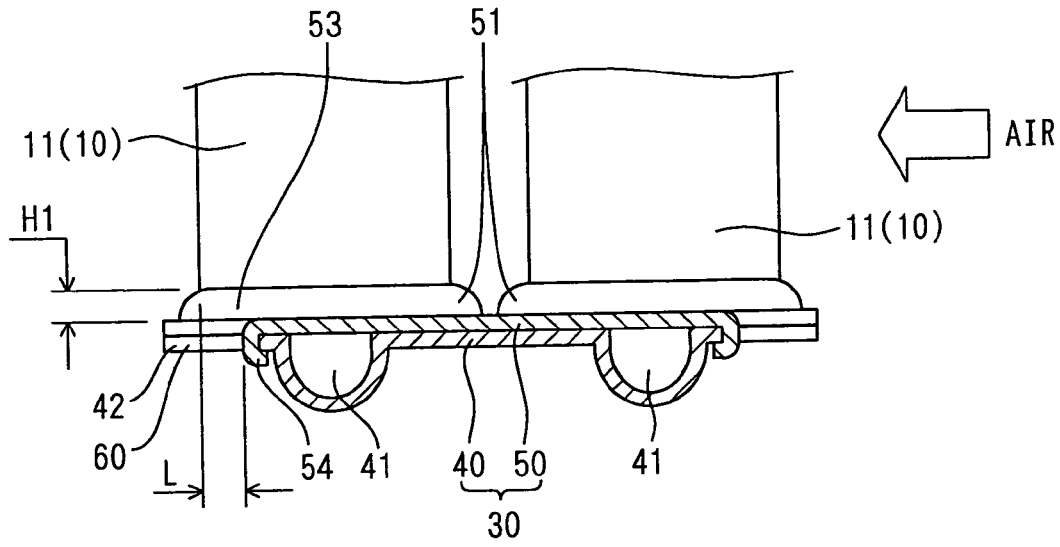
FIG. 6 is an enlarged cross sectional view taken along a line VI—VI in FIG. 4.

FIG. 1 is a front elevational view showing an evaporator according to a first embodiment of the present invention, wherein the evaporator is used in a super critical refrigerating cycle operated with refrigerant of carbon dioxide. FIG. 2 is a side view when viewed from a left-hand side. FIG. 3 is a schematic view showing flow of refrigerant in an evaporator. FIG. 4 is a cross sectional enlarged view taken along a line III—III in FIG. 1, wherein tubes are partly shown. FIG. 5 is a cross sectional enlarged view taken along a line V—V in FIG. 4. FIG. 6 is a cross sectional enlarged view taken along a line VI—VI in FIG. 4.

The super critical refrigerating cycle means a refrigerating cycle in which a pressure of refrigerant on a high-pressure side becomes higher than a critical pressure.

An evaporator 1 is vertically arranged, as indicated by an arrow, in a unit case (not shown) of an air conditioning apparatus for a motor vehicle. Air is blown from a blower fan (not shown) in a direction of an arrow in FIG. 2, and refrigerant is heat exchanged with the air passing through the evaporator 1.

As shown in FIG. 1, the evaporator 1 comprises a core portion 10 and a pair of upper and lower tanks 20 and 30, wherein those elements are made of aluminum base alloy, assembled together by fitting, caulking and so on, and integrally fixed to each other by soldering. Soldering material is in advance formed on necessary portions of those elements.

The core portion 10 comprises multiple vertically extending tubes, through which the refrigerant flows, and multiple corrugated fins 12, and the core portion 10 is built-up by alternately arranging the tubes and fins. A pair of side plate 13 is fixed by soldering to the outermost fins 12 at both sides of the core portion 10. The side plates 13 are formed as a reinforcing element.

The tube 11 is formed of a tube having multiple holes forming fluid passages, and the fin 12 is formed from the corrugated type, as shown in the drawings. It should not be, however, limited to such type of the tube having multiple holes or to the corrugated type fins. Any other types of tubes and fins, for example tubes having inner fins or plate type fins, can be alternatively used for the purpose of the present invention.

The pair of upper and lower tanks 20 and 30 is fixed to tube ends 11*a* of the tubes 11. The tanks 20 and 30 are horizontally extending in a tube laminating direction.

The tube ends 11*a* are fixed to the tanks 20 and 30 by soldering, so that the fluid passages formed in the tubes 11 are communicated with inside spaces of the tanks 20 and 30, more specifically communicated with fluid passage portions 41 formed in the tanks and extending in the tube laminating direction. The detailed structure will be further explained later.

A pair of end caps 21 and 31 is respectively fixed by soldering to both longitudinal ends of the tanks 20 and 30, to close the ends of the fluid passage portions 41 (See FIG. 2).

In the evaporator 1 of the first embodiment, as shown in FIG. 2, two lines of the tubes 11 are arranged in a direction of air flow, namely one line is arranged at an upstream side and the other line is arranged at a downstream side. The direction of the air flow is perpendicular to a plane formed by the core portion 10. Two lines of the fluid passage portions 41 are formed at the tanks 20 and 30, corresponding to the two lines of the tubes 11.

As shown in FIGS. 1 and 2, a joint block 7 is formed at an upper and left side portion, at which an inlet port 8 and an outlet port 9 for the refrigerant are formed. The inlet port 8 is communicated with the fluid passage portion 41 formed at the upper tank 20 and at the downstream side of the air flow. The outlet port 9 is communicated with the fluid passage portion 41 formed at the upper tank 20 and at the upstream side of the air flow.

A separating element (not shown) is provided in the respective fluid passage portions 41 of the upper tank 20, at an almost middle portion thereof. Accordingly, as shown in FIG. 3, the refrigerant flowing from the inlet port 8 flows in the evaporator 1 through the fluid passage portion 41*a* of the upper and downstream side, a first core portion 10*a* of the downstream and left-hand side, the fluid passage portion 41*b* of the lower tank 30 of the downstream side, a second core portion 10*b* of the downstream and right-hand side, the fluid passage portion 41*c* of the upper tank 20 of the downstream and right-hand side, the fluid passage portion 41*d* of the upper tank 20 of the upstream and right-hand side, a third core portion 10*c* of the upstream and right-hand side, the fluid passage portion 41*e* of the lower tank 30 of the upstream side, a fourth core portion 10*d* of the upstream and left-hand side, the fluid passage portion 41*f* of the upper tank 20 of the upstream and left-hand side, and to the outlet port 9.

Although not shown in the drawings, the fluid passage portions 41*c* and 41*d* are communicated with each other by any suitable means, such as a pipe.

As shown in FIG. 5, an outer shape of the lower tank 30 is made larger than a width of the tube 11 in the air flow direction (a direction perpendicular to the plane formed by the core portion 10). The tube ends 11*a* are vertically inserted into and fixed to the lower tank 30.

The lower tank 30 is formed from a tank element 40 and a tank plate 50. Protruding portions are formed at the tank element 40 to form the fluid passage portions 41. A width "W1" of the fluid passage portion 41 is made smaller than a width "W2" of the tube 11.

The tank plate 50, which is an upper part of the lower tank 30, has oval-dome shaped extended portions 51 which are longitudinally formed at equal intervals to a pitch of the laminated tubes 11, wherein the tube ends 1*a* are fixed to the extended portions 51. The inside space of the extended portions 51 forms a fluid flow space 52 for communicating the fluid passage portions 41 with the fluid passages formed in the tubes 11. The tubes 11 have a larger width (W2) than that (W1) of the fluid passage portions 41.

The fluid flow spaces 52 are formed at such portions respectively opposing to the tube ends 11*a*, but not formed at such portions between the adjacent tubes 11. FIG. 6 is a cross sectional view taken along a line VI—VI of FIG. 4, and as seen from FIG. 6, any fluid flow spaces 52 are not formed at this portion.

The tube ends 11*a* protrude into the fluid flow spaces 52. A length of the protruding portion is made smaller than a height of the fluid flow space 52 formed by the extended portions 51, so that a sufficient flow passage for the refrigerant in the fluid flow space 52 is assured. An increase of pressure loss for the refrigerant flowing through the lower tank 30 is suppressed.

As is further shown in FIG. 4 and FIG. 6, multiple drainage recesses 60 are formed at a front (upstream) side and a rear (downstream) side of the tank 30. Each of spaces (drainage passages) formed by the drainage recesses 60 vertically passes through.

The drainage recesses 60 are formed at the equal intervals to the pitch of the laminated tubes 11, and arranged at such portions between longitudinally adjacent tubes 11. The recesses 60 are separated from the fluid flow spaces 52 formed in the lower tank 30. Further, the drainage recesses 60 are arranged between the longitudinally adjacent tubes 11 at such portions, or in other words, the drainage recesses 60 are cut into to such portions, at which the vertical spaces formed by the recesses do not overlap (interfere) with the fluid passage portions 41 when viewed in the vertical direction. Namely, the drainage recesses 60 are arranged to be separated from the fluid passage portions 41 and the fluid flow spaces 52 but intruded in such portions interposed between the adjacent tubes 11.

Outer surfaces 53 of the extended portions 51 facing to the drainage recesses 60 are formed with inclined planes, which go down from the fixing portion between the tube 11 and the tank plate 50 toward the drainage recesses 60.

Multiple notched portions 42 are likewise formed at a front (upstream) side and a rear (downstream) side of the tank element 40, so that the shape of the notched portions 42 correspond to the shape of the drainage recesses 60. Multiple claw portions 54 are formed at such portions of the tank plate 50, at which the claw portions 54 are opposing to the notched portions 42, so that the claw portions 54 can be downwardly bent (by caulking method). The tank element 40 and the tank plate 50 are thus assembled together.

In the above explained drawings, the corrugated fins 12 are only partly shown in FIG. 1, and the fins 12 are omitted from FIGS. 4 to 6.

An operation of the evaporator 1 will be explained.

The inlet port 8 of the evaporator 1 shown in FIG. 2 is connected to a depressurizing device (not shown) of the refrigerating cycle, while the outlet port 9 is connected to a suction port of a compressor (not shown).

A gas-phase and liquid-phase refrigerant of low-temperature and low-pressure, which has been depressurized by the depressurizing device, flows into the evaporator 1 through the inlet port 8. The refrigerant is evaporated by absorbing heat from the air passing through the core portion 10, and gas-phase refrigerant is sucked into the compressor.

The air passing through the evaporator is cooled down at outer surfaces of the core portion 10, and steam contained in the air is condensed to become condensed water. The condensed water flows down along the tubes 11 of the core portion 10 and reaches at an upper surface of the lower tank 30.

Most of the condensed water reaching at the upper surface of the lower tank 30 flows along the inclined planes 53 of the extended portions 51 and is guided to the drainage recesses 60. The condensed water is downwardly drained out through the recesses 60 to a drain pipe (not shown) provided in the unit case of the air conditioning apparatus, and finally drained out from the vehicle.

According to the above described evaporator, the drainage recesses 60 are formed in the lower tank 30 in such a manner that the drainage recesses 60 do not interfere with the fluid passage portions 41 and fluid flow spaces 52 formed in the inside of the lower tank 30. The condensed water generated at the core portion 10 is drained out through the drainage recesses 60. A drainage performance can be improved, when compared with such an evaporator having no such drainage recesses.

The drainage recesses 60 are formed to vertically pass through in the evaporator of the above embodiment. On the other hand, when compared with such a conventional evaporator, in which drain guide grooves having inclined planes are formed (instead of recesses, as in the present invention) adjacent to the upper surfaces of the lower tank, the drainage performance of the present invention is much more improved.

If the condensed water stays around the upper surface portions of the lower tank 30 or at a lower part of the core portion 10, effective heat transfer area is reduced and thermal resistance is increased in response to an increase of thickness of water film. As a result, heat exchange performance of the evaporator 1 may be adversely affected.

According to the above described present invention, however, the decrease of the heat exchange performance is prevented, since the drainage performance from the upper surface portions of the lower tank 30 is improved.

Furthermore, according to the present invention, water-fly by the blowing air (water-fly into the passenger compartment of the vehicle) can be prevented, because the retention of the condensed water at the evaporator is suppressed.

Even in the case that a temperature sensor is provided at a downstream side of the evaporator 1 and adjacent to the lower part of the core portion 10, for sensing temperature of the air to be blown into the passenger compartment, a precise sensing of the temperature can be achieved, and a frost at the evaporator 1 due to an erroneous temperature detection can be avoided, since the retention of the condensed water at the evaporator is suppressed.

The drainage recesses 60 are formed in the lower tank 30, in such a manner that they penetrate into the lower tank 30 at such portions at which the recesses 60 do not overlap with the fluid passage portions 41 and the fluid flow spaces 52 in the vertical direction. The tubes 11 are fixed to the extended portions 51 of the tank plate 50. According to the above structures, the condensed water flowing down along the tubes 11 can be guided to the drainage recesses 60 by the inclined surfaces 53.

When compared with such an evaporator having no inclined surfaces 53, the condensed water can be more effectively drained out in the present invention (having the inclined surfaces 53), since dropping energy of the condensed water flowing down along the tubes is not largely reduced by the inclined surfaces 53.

Even when the water film of the condensed water is formed on the surfaces of the recesses 60, the water film is broken down by the dropping energy of the condensed water flowing down along the tubes 11, and those waters can be drained together. As above, the condensed water can be surely drained out by the drainage recesses 60 and the inclined surfaces 53.

According to the experimental results of the present inventors, a length (a depth of a recess) "L" shown in FIG. 6 is preferably larger than 2.0 mm, wherein the length (depth) "L" is a distance from an end of the tube 11 in the air flow direction to an inside end of the drainage recess 60. A height "H1" of the extended portion 51, as shown in FIG. 6, is preferably larger than 1.0 mm, so that the inclined surface 53 can be easily formed.

A thickness of the tank plate 50 forming the extended portions 51 is preferably larger than 0.5 mm. The extended portions 51 are formed by a press process or the like, and the thickness of the extended portions 51 is likely to be thinner than the original thickness of the other portions. When the carbon dioxide is used as the refrigerant, the refrigerant pressure on a low-pressure side is generally between 3.5 and 4.5 Mpa. When the thickness of the extended portions 51 is made larger than 0.5 mm, the evaporator with such extended portions can sufficiently resist against such high pressure.

Figure 7:
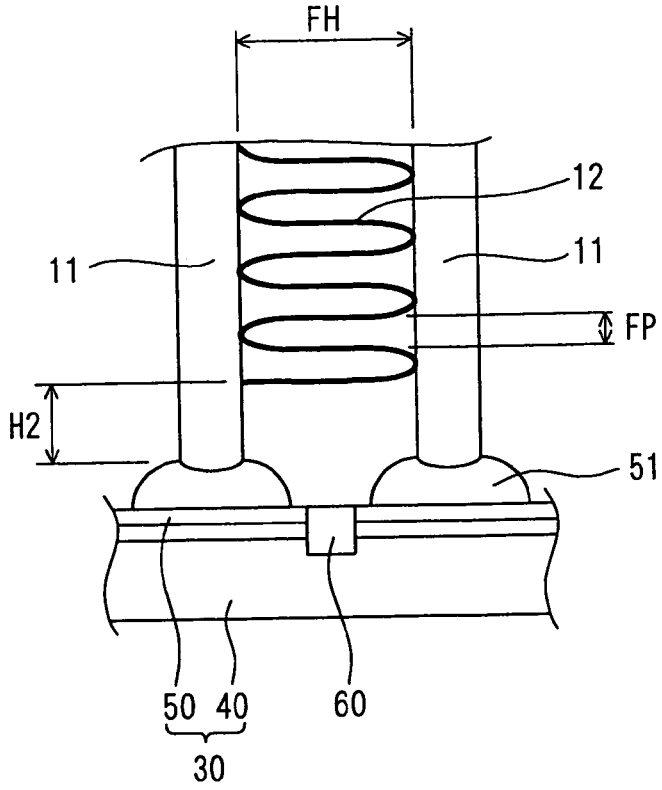
FIG. 7 is an enlarged front view showing a part of the evaporator shown in FIG. 1.

A distance "H2" shown in FIG. 7 is preferably less than 5.0 mm, wherein the distance "H2" is a distance from the upper surface of the extended portions 51 to a lower end of the corrugated fins 12.

In the case that the distance "H2" is made larger than 5.0 mm, in order to suppress the retention of the condensed water on the upper surface portions of the tank 30, an amount of air passing through such portions of the evaporator 1, at which the corrugated fins 12 do not exist between the neighboring tubes 11, is increased. And thereby the heat exchange performance is decreased.

According to the present invention, even when the distance "H2" is made smaller than 5.0 mm, the condensed water can be effectively drained out, so that the heat exchange performance can be enhanced.

The claw portions 54 formed in the tank plate 50 are downwardly bent in the notched portions 42 formed in the tank element 40, so that the drainage recesses 60 are easily formed. Further, since the claw portions 54 are downwardly bent, the flow of the condensed water on the upper surfaces is not adversely affected.

According to the present invention, a fin pitch "FP" of the corrugated fins 12 shown in FIG. 7 is preferably less than 4.0 mm, a distance between the neighboring tubes 11 (namely, a height "FH" of the corrugated fins 12) is preferably less than 10.0 mm, and a width "D" of the core portion 10 (shown in FIG. 4) is preferably less than 65.0 mm.

In the case that an evaporator does meet any one of the above dimensions ("FP", "FH" and "D") but the drainage recesses are not formed in the evaporator, the condensed water is likely to stay at the lower part of the core portion 10, and the thickness of the water film is likely to be increased.

In other words, when the evaporator does meet at least one of the above dimensions ("FP", "FH" and "D") and the drainage recesses are formed in the evaporator, a high drainage performance can be achieved.

Second Embodiment

A second embodiment is explained with reference to FIGS. 8A and 8B, which correspond respectively to FIGS. 6 and 4.

Figure 8A:
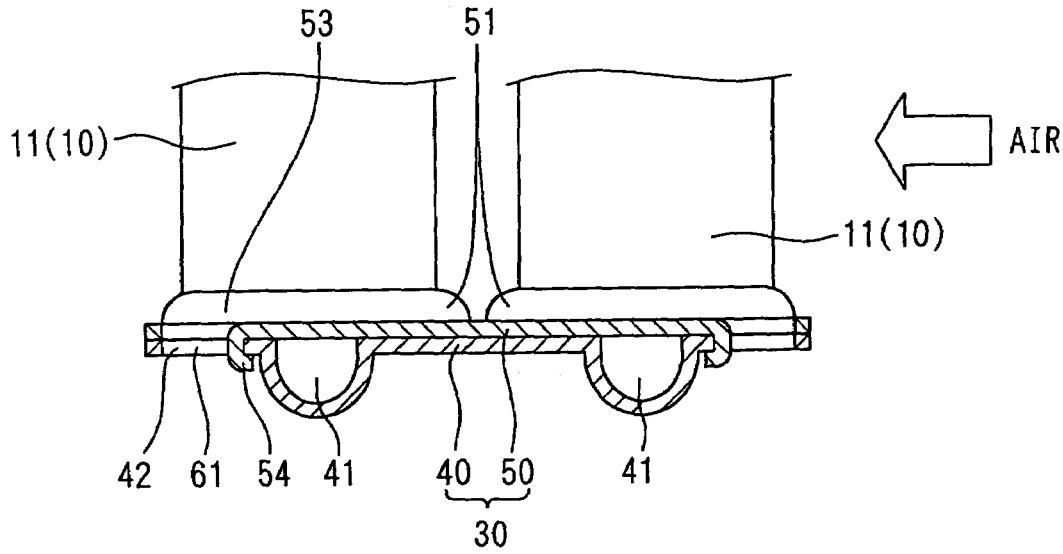
FIG. 8A is an enlarged cross sectional view of an evaporator according to a second embodiment, corresponding to FIG. 6.
Figure 8B:
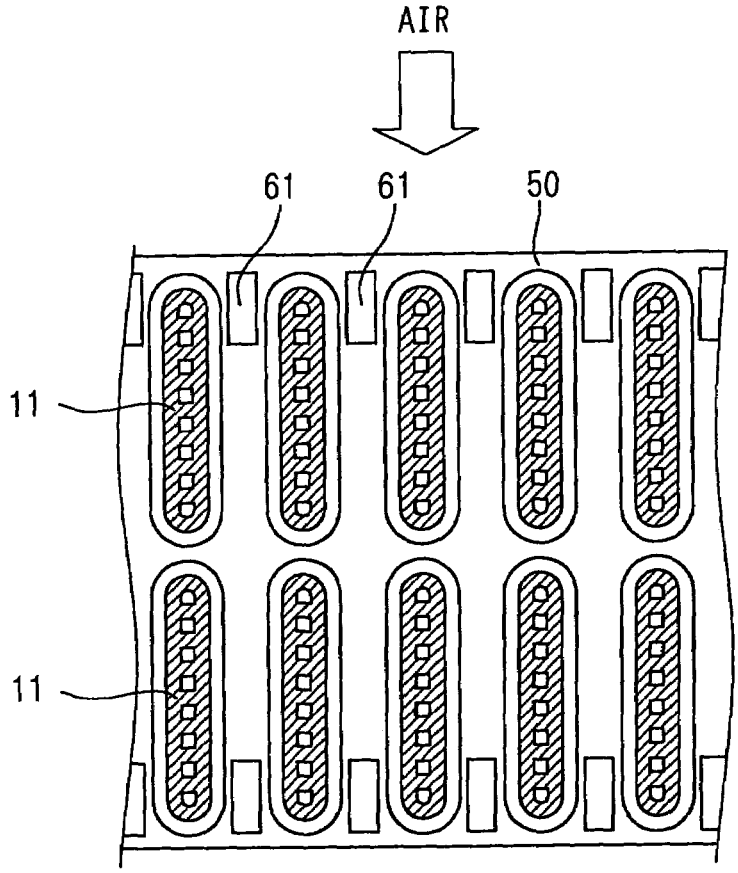
FIG. 8B is a cross sectional view of the evaporator shown in FIG. 8A, corresponding to FIG. 4.

As apparent from FIGS. 8A and 8B, the second embodiment differs from the first embodiment in the shape of the drainage means.

According to the second embodiment, multiple drainage holes 61 are formed in the lower tank 30 in such a manner that the drainage holes 61 vertically pass through the tank element 40 and the tank plate 50 without interfering with the fluid passage portions 41 and the fluid flow spaces 52.

As in the same manner to the first embodiment, the notched portions 42 are formed in the tank element 40 and the claws 54 formed in the tank plate 50 are downwardly bent to tightly fix the tank element 40 to the tank plate 50.

With such arrangement of the second embodiment, the condensed water can be surely drained out from the upper surface portions of the lower tank 30 through the drainage holes 61.

Third Embodiment

A third embodiment is explained with reference to FIGS. 9A and 9B, which correspond respectively to FIGS. 6 and 4.

Figure 9A:
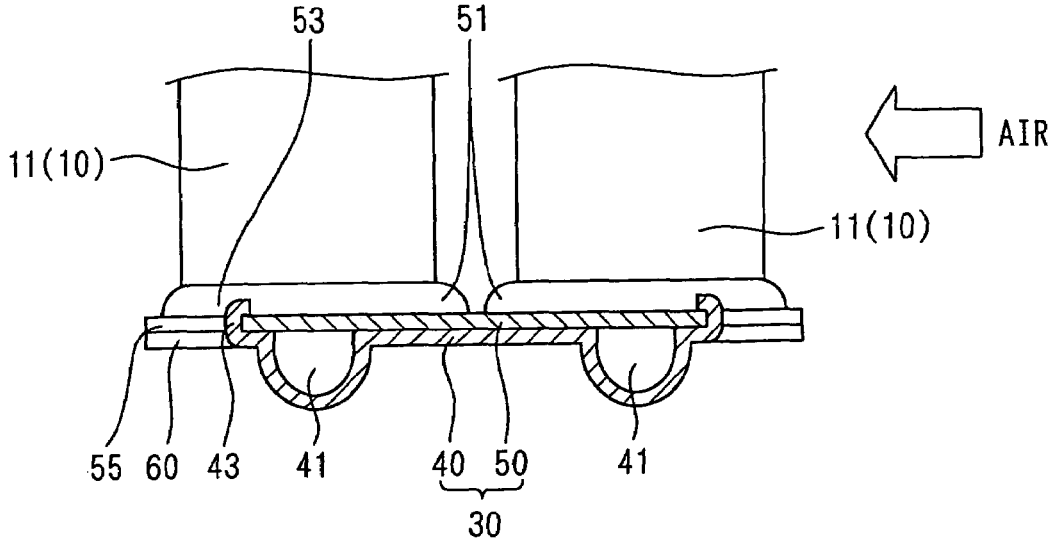
FIG. 9A is an enlarged cross sectional view of an evaporator according to a third embodiment, corresponding to FIG. 6.
Figure 9B:
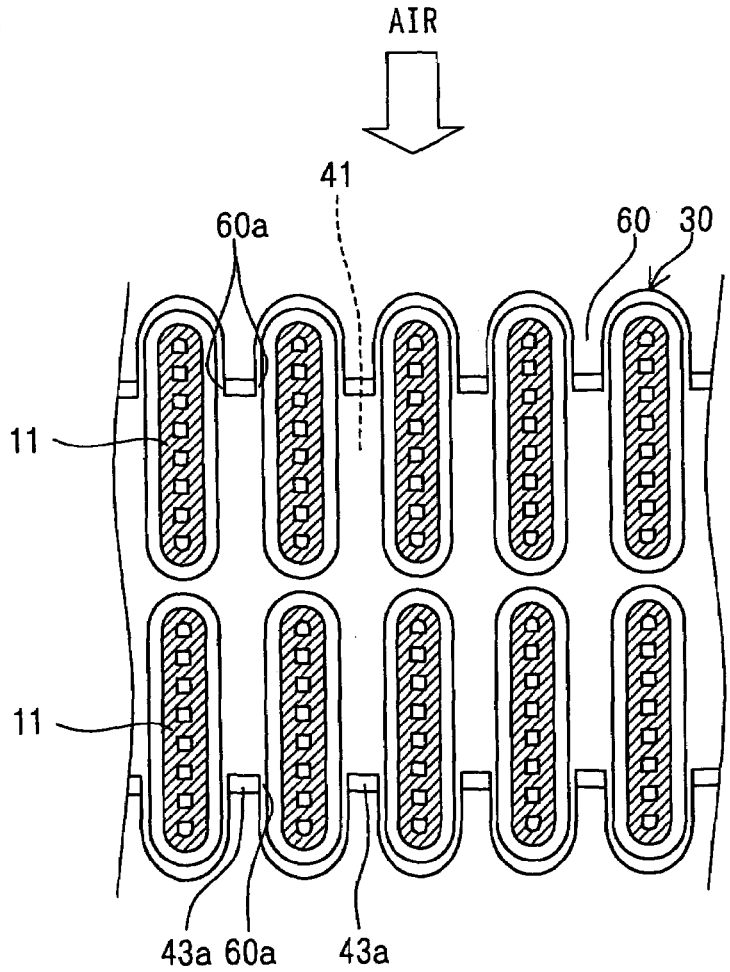
FIG. 9B is a cross sectional view of the evaporator shown in FIG. 9A, corresponding to FIG. 4.

As apparent from FIGS. 9A and 9B, the third embodiment differs from the first embodiment in the notched portion and the claw portions.

According to the third embodiment, multiple notched portions 55 are formed in the tank plate 50 and multiple claw portions 43 are formed in the tank element 40, wherein the claw portions 43 are upwardly bent to tightly fix the tank element 40 and the tank plate 50 with each other, so that the drainage recesses 60 are likewise formed between the neighboring tubes 11.

The condensed water flowing down to the upper surface portions of the lower tank 30 flows towards the drainage recesses 60 through spaces 60*a* between the forward ends 43*a* of the claw portions 43 and outer side surfaces of the tubes 11. Accordingly, with such arrangement of the third embodiment, the condensed water can be surely drained out from the upper surface portions of the lower tank 30 through the drainage recesses 60.

Fourth Embodiment

A fourth embodiment is explained with reference to FIG. 10, which corresponds to FIG. 4.

Figure 10:
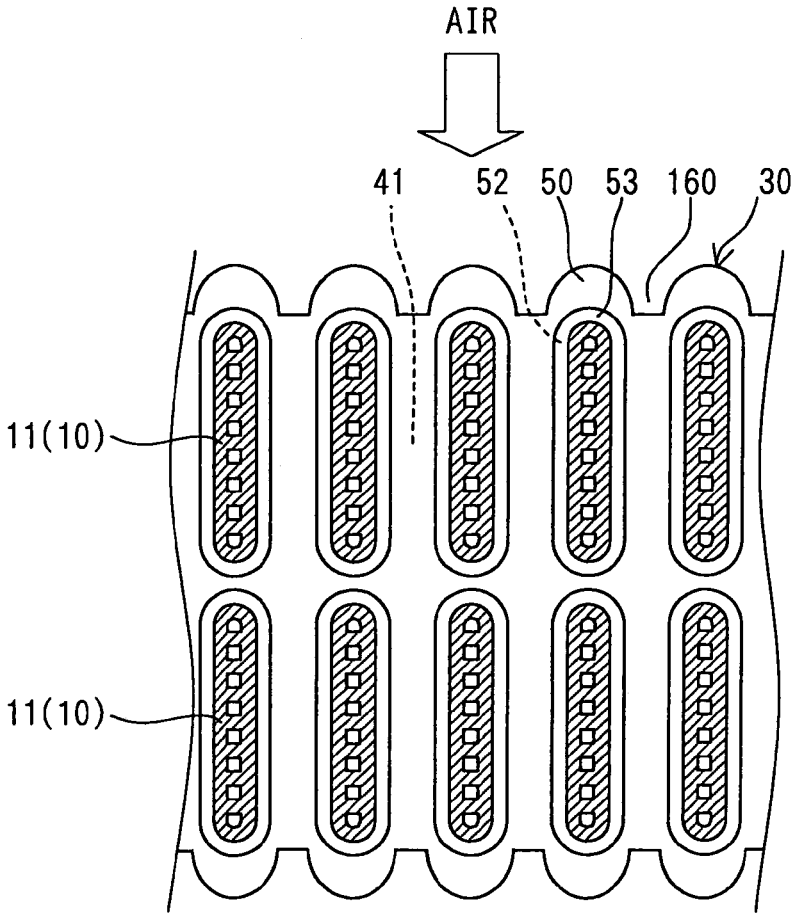
FIG. 10 is a cross sectional view of an evaporator according to a fourth embodiment, corresponding to FIG. 4.

As apparent from FIG. 10, the fourth embodiment differs from the first embodiment in the shape of the drainage recesses.

A length of drainage recesses 160 in the air flow direction is made smaller than the first embodiment, so that any portion of the drainage recesses 60 does not protrude into areas formed between the neighboring tubes 11.

With such arrangement of the fourth embodiment, a similar effect for the drainage performance can be obtained.

Fifth Embodiment

A fifth embodiment is explained with reference to FIGS. 11 and 12, which respectively correspond to FIGS. 5 and 6.

Figure 11:
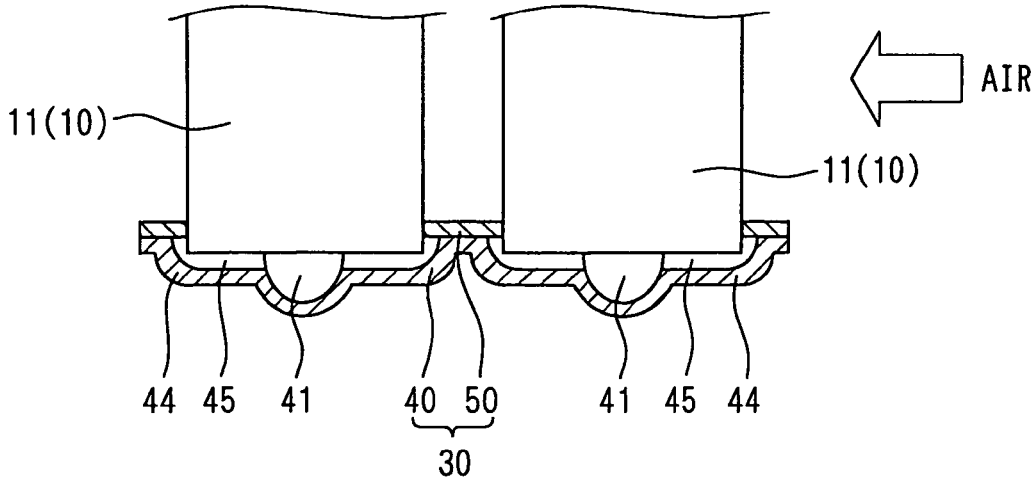
FIG. 11 is an enlarged cross sectional view of an evaporator according to a fifth embodiment, corresponding to FIG. 5.
Figure 12:
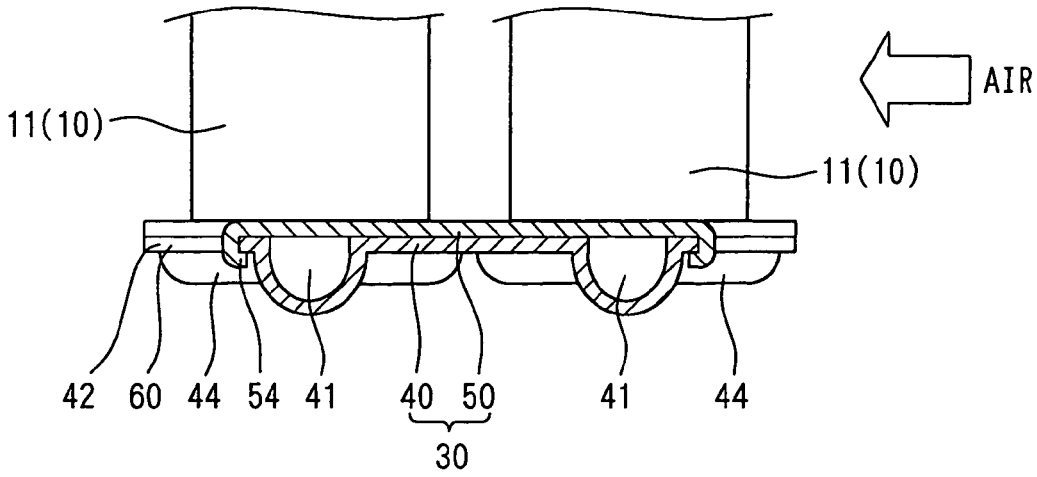
FIG. 12 is an enlarged cross sectional view of the evaporator according to the fifth embodiment, corresponding to FIG. 6.

As apparent from FIGS. 11 and 12, the fifth embodiment differs from the first embodiment in the shape of the lower tank 30, more particularly the shape of the tank element 40 and the tank plate 50.

According to the fifth embodiment, the fluid passage portions 41 as well as fluid flow spaces 45 are formed by the tank element 40. The tank element 40 is formed with oval-dome shaped and downwardly extended portions 44, which are longitudinally formed at equal intervals to the pitch of the laminated tubes 11, wherein the tube ends are fixed to the flat tank plate 50. The inside space of the extended portions 44 forms the fluid flow spaces 45 for communicating the fluid passage portions 41 with passages formed in the tubes 11, which have a larger width than that of the fluid passage portions 41.

As shown in FIG. 12, the drainage recesses 60 are formed at such portions being separated from the fluid flow spaces 45 and the fluid passage portions 41.

Although the inclined surfaces corresponding to the inclined surfaces 53 of the first embodiment are not formed in the fifth embodiment, the condensed water can be surely drained out from the upper surface portions of the lower tank 30 through the drainage recesses 60.

Sixth Embodiment

A sixth embodiment is explained with reference to FIG. 13, which corresponds to FIG. 4.

Figure 13:
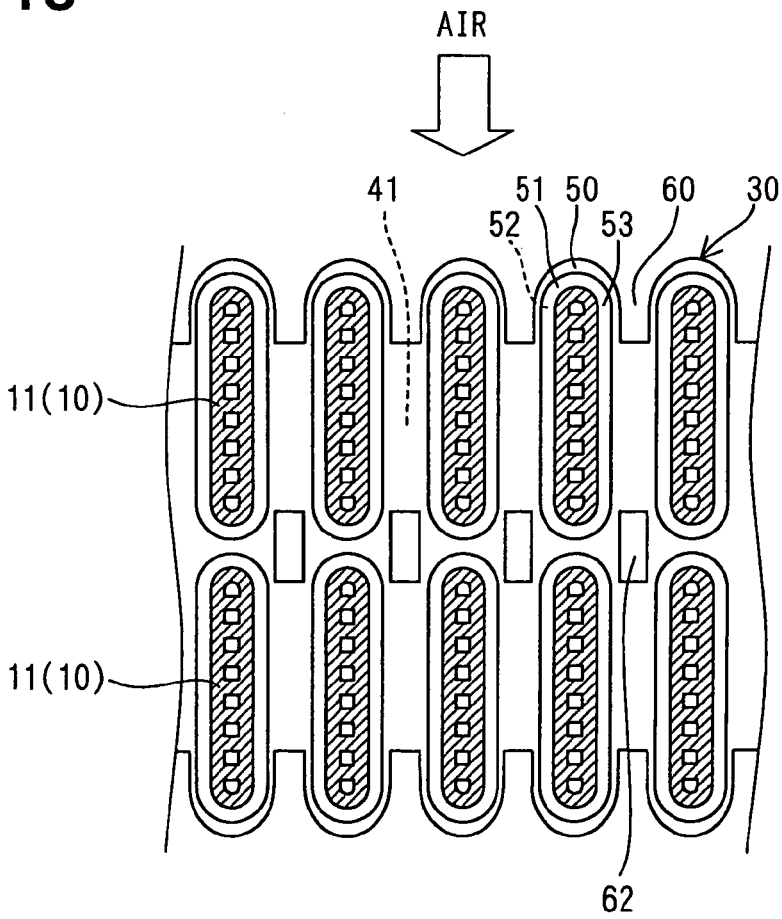
FIG. 13 is a cross sectional view of an evaporator according to a sixth embodiment, corresponding to FIG. 4.

As apparent from FIG. 13, the sixth embodiment differs from the first embodiment in the shape of the lower tank 30. More specifically, drainage holes 62 are additionally formed in the lower tank 30.

The drainage holes 62 are formed at such portions between two lines of the tubes 11 (between a first (upstream) line of laminated tubes and a second (downstream) line of laminated tubes), at which the drainage holes do not interfere with the fluid passage portions 41 and the fluid flow spaces 52. Each end of the drainage holes 62 are extending, in the air flow direction, partly into those areas which are covered by the neighboring tubes 11.

According to the sixth embodiment, the condensed water can be drained out through the drainage recesses 60 and the drainage holes 62, and the drainage performance is further improved.

Seventh Embodiment

A seventh embodiment is explained with reference to FIGS. 14 to 17, wherein FIGS. 14 and 15 respectively correspond to FIGS. 5 and 6.

As apparent from FIGS. 14 to 17, the seventh embodiment differs from the first or the sixth embodiment in the shape of the lower tank.

In the first embodiment, two fluid passage portions 41 are respectively formed in the lower tank 30 corresponding to the two lines of the laminated tubes 11, and the multiple fluid flow spaces 52 are formed for the respective lines of the tubes 11. According to the seventh embodiment, however, fluid flow spaces 145 are formed in the lower tank 103 for respectively communicating the tubes 11 of the first line with the tubes 11 of the second line.

The tank element 40 is formed with oval-dome shaped and downwardly extended portions 144, which are longitudinally arranged at equal intervals to the pitch of the laminated tubes 11, wherein the tube ends are fixed to the flat tank plate 50.

The inside space of the respective extended portions 144 forms the fluid flow space 145 for communicating the fluid passage formed in the tube 11 of the first (upstream) line with the fluid passage formed in the other tube 11 of the second (downstream) line.

Figure 17:
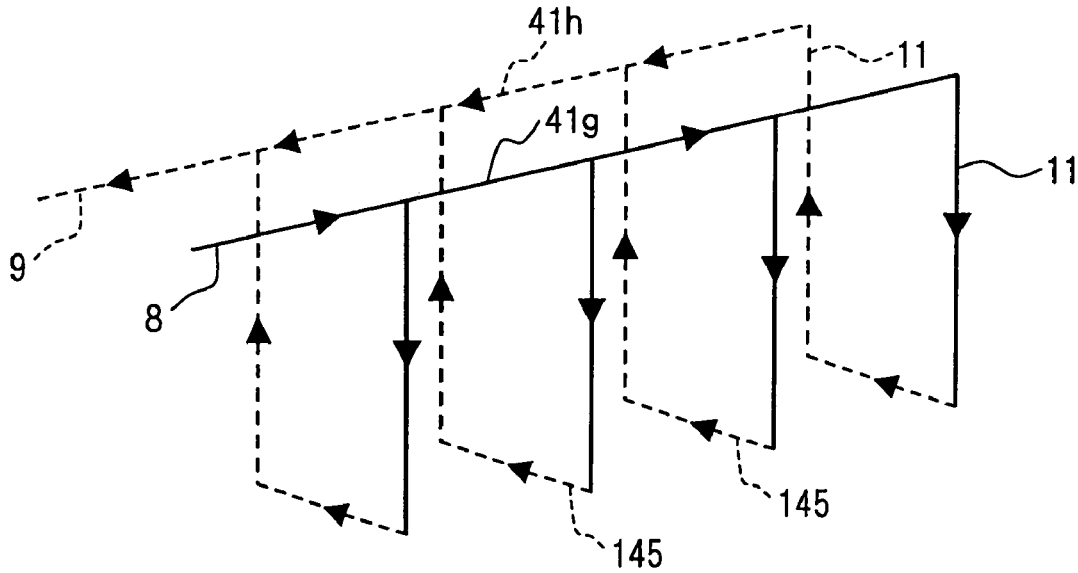
FIG. 17 is a schematic view showing a refrigerant flow in the evaporator shown in FIGS. 14 and 15.

Although not shown in the drawings, the separating elements are not provided in the upper tank 20. The refrigerant flows from the inlet port 8 through the evaporator 1 and flows out from the outlet port 9. More specifically, as shown in FIG. 17, the refrigerant flows down from one of the fluid passage portion 41*g* of the upper tank 20 through the respective tubes 11 of the downstream side of the evaporator to the respective fluid flow spaces 145, then the refrigerant flows up through the respective tubes 11 of the upstream side of the evaporator to the other fluid passage portion 41*h* of the upper tank 20, and finally flows out from the outlet port 9.

Figure 16:
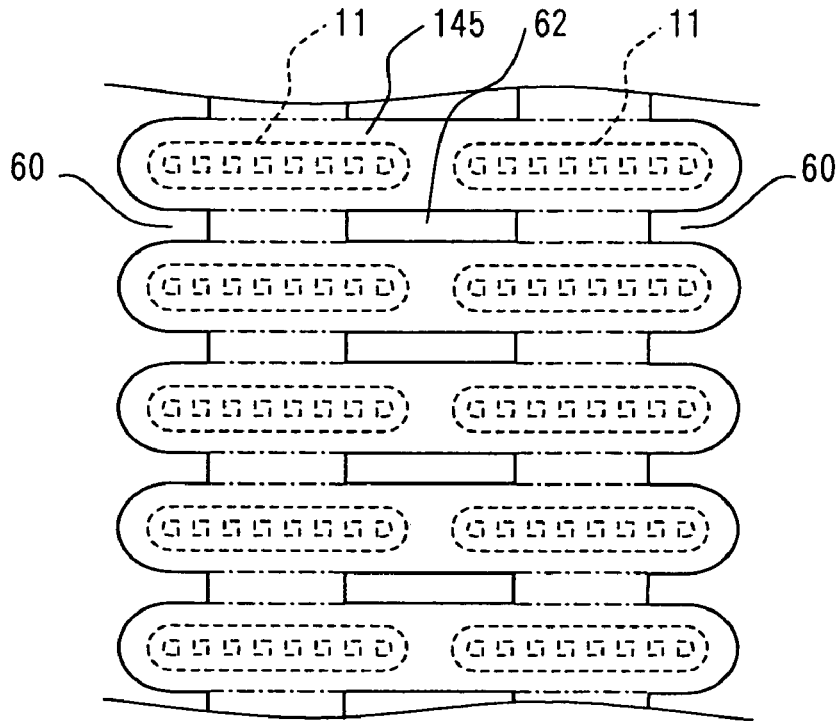
FIG. 16 is a plan view of the evaporator shown in FIGS. 14 and 15, when viewed from the bottom.

As shown in FIG. 16, the drainage recesses 60 and drainage holes 62 are formed at such portions, at which those recesses and holes do not interfere with the fluid flow spaces 145.

According to the above seventh embodiment, the condensed water can be drained out through the drainage recesses 60 and the drainage holes 62, as in the same manner to the sixth embodiment, and the drainage performance is further improved.

Furthermore, the fluid passage portions corresponding to the fluid passage portions 41 of the first embodiment, which would otherwise extend longitudinally in the lower tank 130, are not formed in the seventh embodiment. Accordingly, larger spaces for the drainage recesses 60 and the drainage holes 62 can be obtained.

Other Embodiments

The present invention should not be limited to the above embodiments. Any other modifications can be possible.

Figure 18:
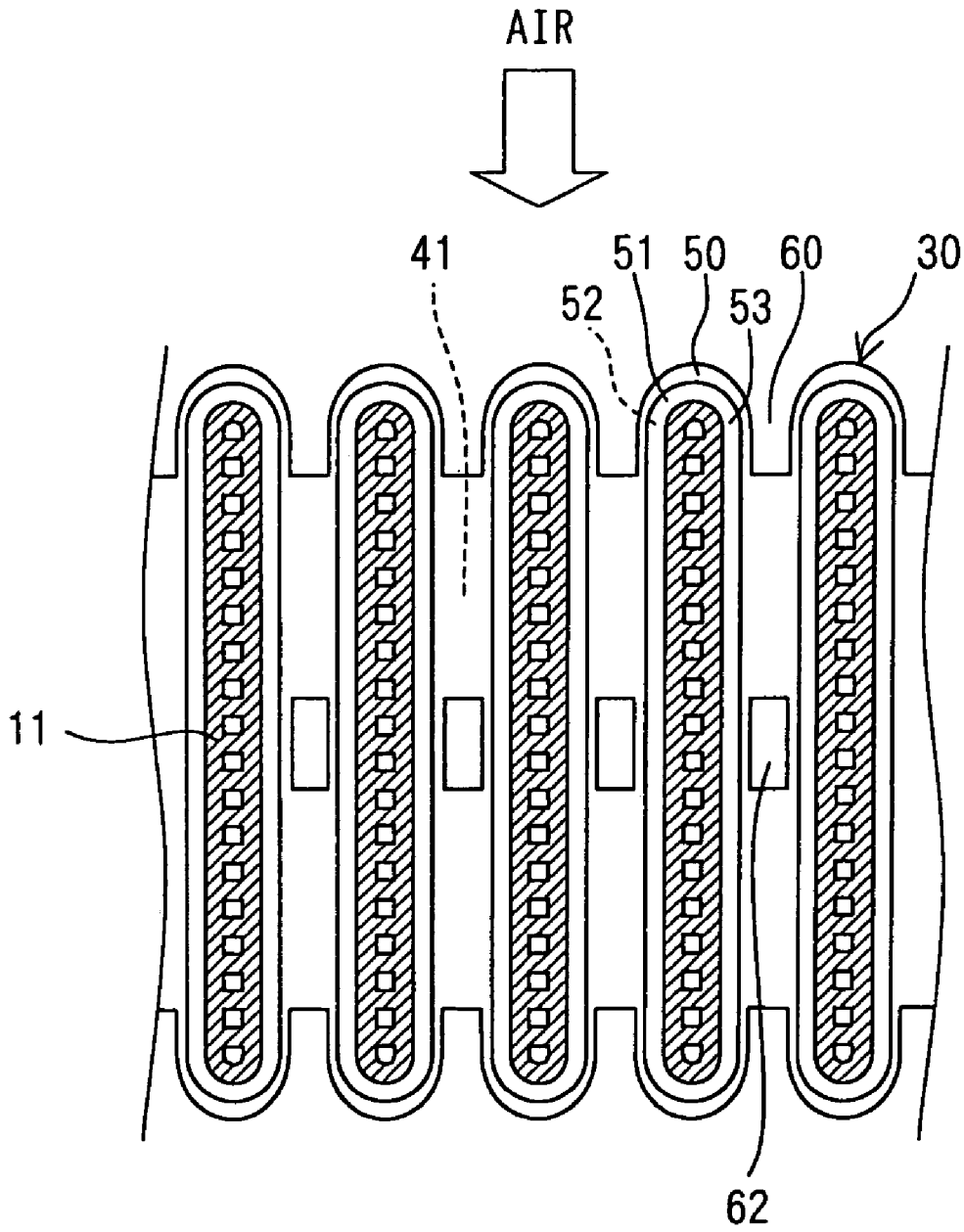
FIGS. 18 to 23 are respectively showing further modifications of the present invention.

FIG. 18 shows a modification, in which the tubes 11 are arranged in one line.

Figure 19:
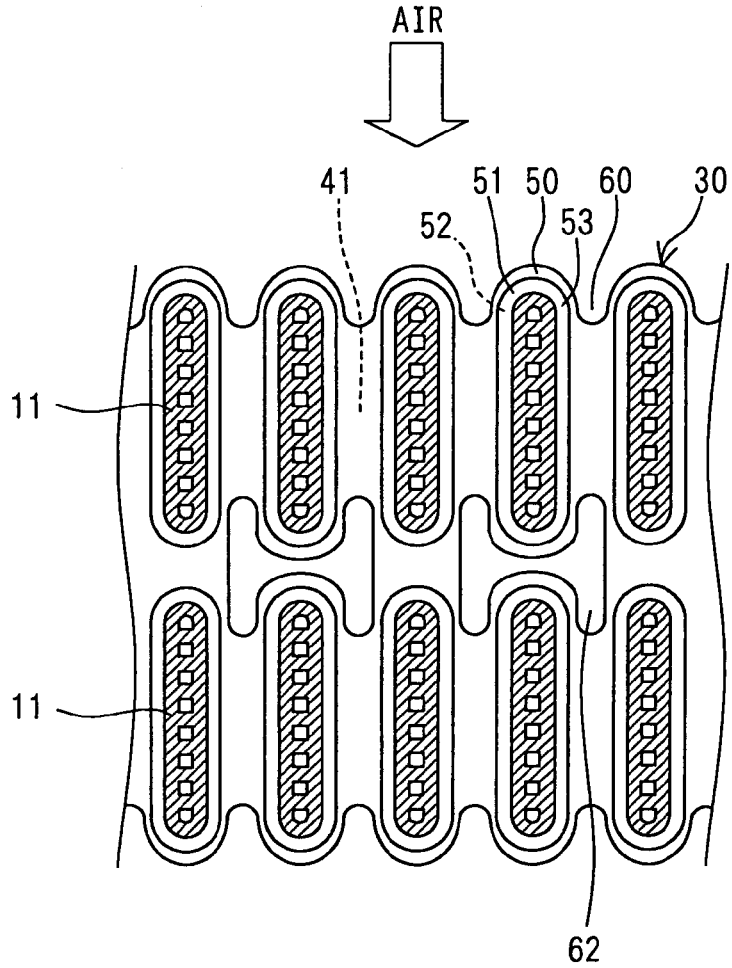

FIG. 19 shows another modification, in which the drainage holes 62 are formed into H-shaped holes.

Figure 20:
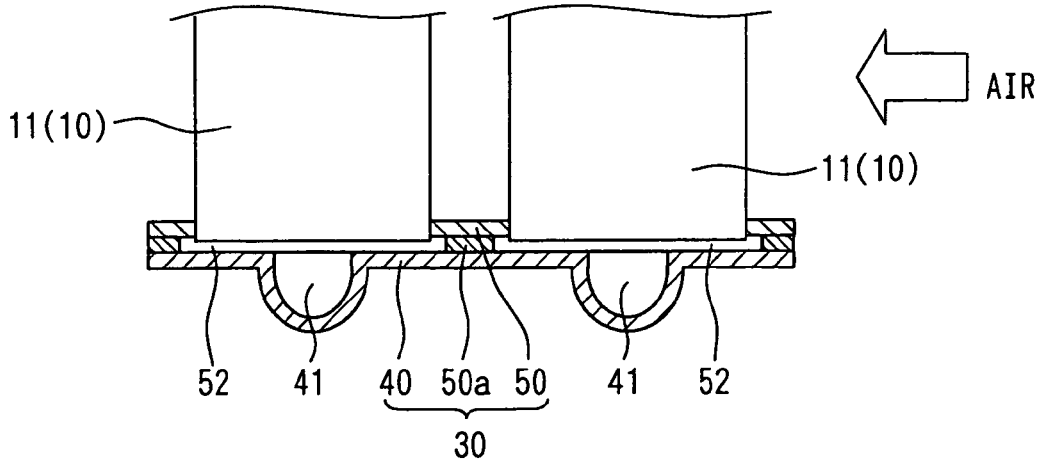

FIG. 20 shows a further modification, in which intermediate plate 50*a* is interposed between the tank element 40 and the tank plate 50.

Figure 21:
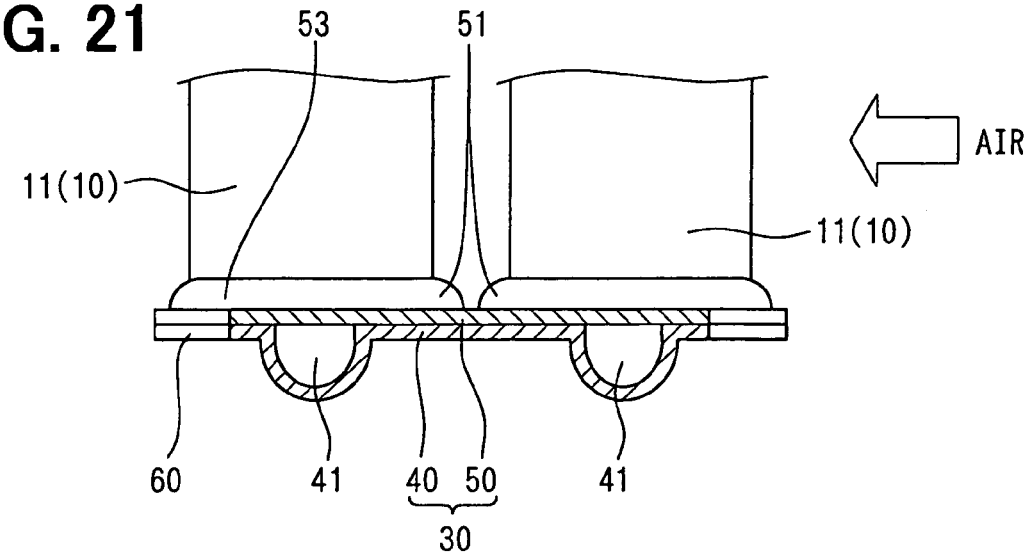

FIG. 21 shows a further modification, in which the claw portions corresponding to the claw portions 54 of the first embodiment shown in FIG. 6 are eliminated, wherein the tank element 40 and the tank plate 50 are fixed to each other by soldering or any other methods.

The drainage recesses and drainage holes must not be formed in a strict vertical direction, and can be inclined.

It is already explained in connection with FIG. 7, that the distance "H2" is preferably less than 5.0 mm. However, in the case that the distance "H2" is relatively large even within the above dimension, for example between 3.0 to 5.0 mm, it is preferable to provide a windbreak plate at an upstream (or a downstream) side of the core portion 10, so that the air flow flowing through the spaces between the upper surface of the lower tank 30 and the lower ends of the corrugated fins 12 is suppressed. With such an arrangement, the heat exchange performance can be further improved.

Figure 22:
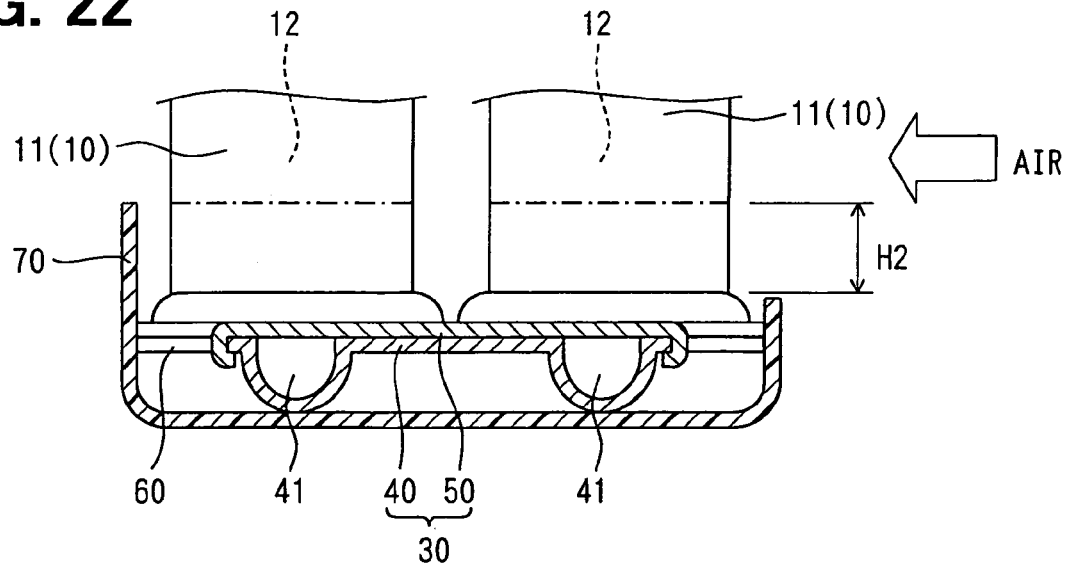

For example, FIG. 22 shows a modification, in which a windbreak wall 70 is provided at the downstream side of the evaporator, wherein a portion of the unit case for supporting the evaporator is extended to form the wall 70, and the height of the wall 70 is made to be almost equal to the distance "H2" (which is the distance between the upper surface of the lower tank 30 and the lower ends of the corrugated fins 12).

Figure 14:
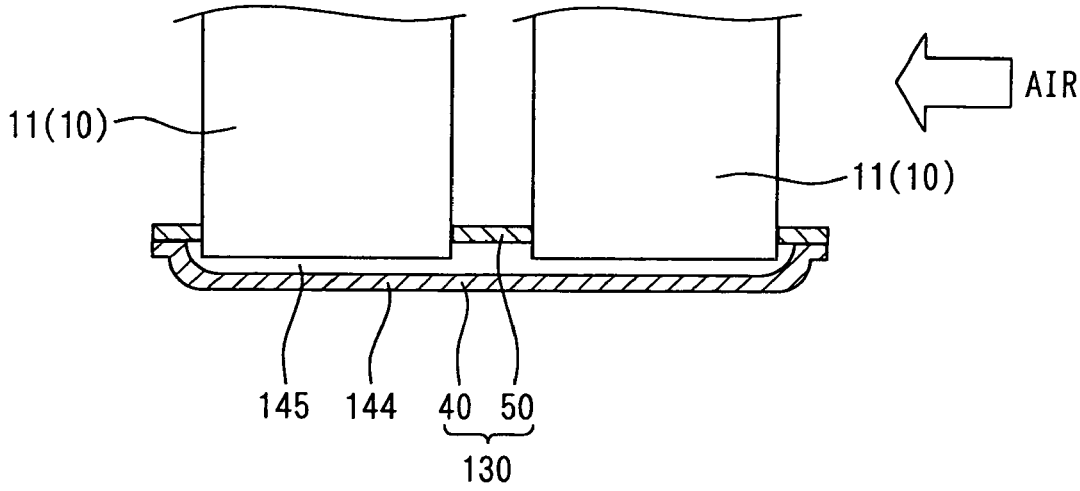
FIG. 14 is an enlarged cross sectional view of an evaporator according to a seventh embodiment, corresponding to FIG. 5.
Figure 15:
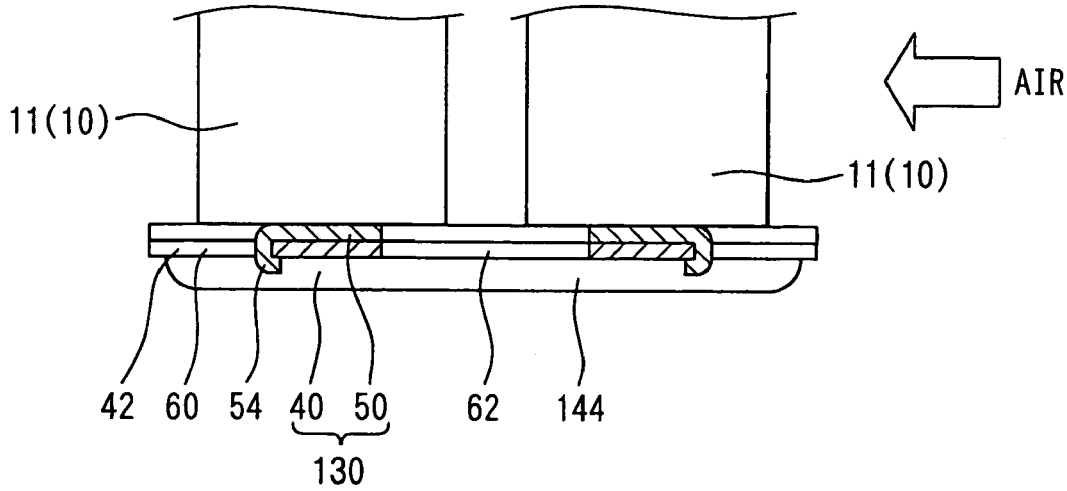
FIG. 15 is an enlarged cross sectional view of the evaporator according to the seventh embodiment, corresponding to FIG. 6.
Figure 23:
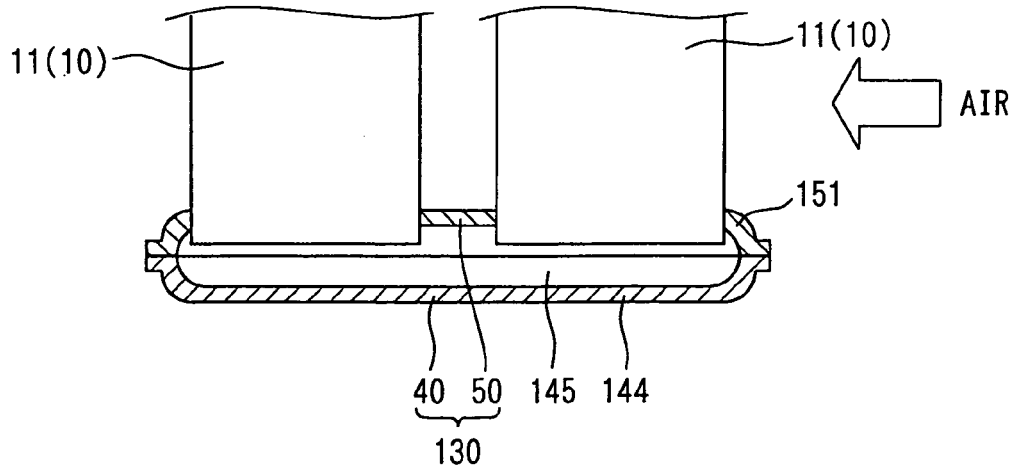

FIG. 23 shows a further modification of the seventh embodiment shown in FIG. 14. In this modification, the tank plate 50 is formed with an upwardly extended portion 151 and the fluid passage portions 145 are formed by the extended portions 144 and 151.

In the above described embodiments or modifications, the drainage recesses and holes are formed in the lower tank. However, similar or identical structures of the recesses and holes can be formed in the upper tank, so that parts for forming the upper and lower tanks can be commonly prepared.

In the above embodiments or modifications, the drainage recesses and holes are formed in the lower tank at its upstream side, downstream side, and/or a middle portion between the two lines of the laminated tubes. However, those drainage recesses and/or holes can be formed at any other portions, at which the recesses and holes do not interfere with the fluid passage portions and the fluid flow spaces, and at which the condensed water can be easily drained out from the evaporator.

The present invention is furthermore not limited to those evaporators having the refrigerant flows, as shown in FIGS. 3 and 17. The present invention can be preferably applied to the evaporators, which are composed of the tubes and tanks, wherein the tubes and the tanks are separate parts.

The refrigerant to be used for the evaporator of the present invention shall not be limited to the carbon dioxide. However, as already described, the refrigerant pressure of the super critical refrigerating cycle using the carbon dioxide is much higher than that of the refrigerating cycle using Freon. In the case that the tubes and the tanks are formed from the different parts, a higher design flexibility, including the design of the plate thickness, can be assured. Accordingly, the present invention can be more preferably, in view of weight saving and cost saving, applied to the evaporators for the super critical refrigerating cycle, in which the evaporators are formed from the different parts.

What is claimed is:

1. An evaporator for an air conditioning apparatus comprising:

a core portion having multiple vertically extending tubes, which are arranged in a line at generally equal intervals in a laminating direction;

an upper tank and a lower tank respectively provided at an upper end and a lower end of the multiple tubes, so that fluid passages formed in the tubes are communicated with inside spaces of the tanks, wherein the tanks are formed as separate parts from the tubes, and a width of the tanks is larger than that of the tubes in a direction perpendicular to a plane formed by the core portion;

a fluid passage portion formed in the lower tank and extending in the laminating direction, wherein a width of the fluid passage portion is smaller than that of the tubes in the direction perpendicular to the plane formed by the core portion, the lower tank defining a flange extending from the fluid passage portion in a direction generally perpendicular to the plane formed by the core portion;

multiple fluid flow spaces formed in the lower tank and opposing to the respective ends of the tubes for communicating the fluid passages of the tubes with the fluid passage portion; and multiple drainage means formed in the flange defined by the lower tank such that the drainage means do not interfere with the fluid passage portion and the fluid flow spaces.

2. An evaporator according to claim 1, wherein the drainage means are recesses formed at side portions of the flange defined by the lower tank.

3. An evaporator according to claim 1, wherein the drainage means are holes formed in the flange defined by the lower tank at an inside area from side portions of the lower tank.

4. An evaporator according to claim 1, wherein the drainage means are formed in the flange defined by the lower tank between neighboring tubes.

5. An evaporator according to claim 4, wherein the drainage means has a length of larger than 2.0 mm in the direction perpendicular to the plane formed by the core portion.

6. An evaporator according to claim 1, wherein the lower tank has a tank plate at its upper side, and multiple upwardly extended portions are respectively formed in the tank plate so that each lower end of the tubes are fixed to the respective extended portions, and each of the extended portions has an inclined surface downwardly extending from a fixing portion, at which the tube is fixed to the extended portion, towards the drainage means.

7. An evaporator according to claim 6, wherein the upwardly extended portion has a height of larger than 1.0 mm.

8. An evaporator according to claim 6, wherein the upwardly extended portion has a thickness of larger than 0.5 mm.

9. An evaporator according to claim 6, wherein a length of the end of the tube protruding into the inside space of the extended portion is smaller than the height of the extended portion.

10. An evaporator according to claim 1, further comprising:

multiple fins provided between the neighboring tubes for increasing heat exchange performance, wherein a height between an upper surface of the lower tank and lower end of the fins is less than 5.0 mm.

11. An evaporator according to claim 10, wherein a height between an upper surface of the lower tank and lower end of the fins is larger than 3.0 mm, and a windbreak wall is provided at an outside of the core portion for suppressing air flow passing through such a portion of the core portion, which is formed between the upper surface of the lower tank and lower end of the fins.

12. An evaporator according to claim 1, further comprising:

multiple fins provided between the neighboring tubes for increasing heat exchange performance, wherein a fin pitch of the fins is less than 4.0 mm.

13. An evaporator according to claim 1, further comprising:

multiple fins provided between the neighboring tubes for increasing heat exchange performance, wherein a distance of the neighboring tubes is less than 10.0 mm.

14. An evaporator according to claim 1, wherein a width of the core portion in the direction perpendicular to the plane formed by the core portion is less than 65.0 mm.

15. An evaporator according to claim 1, wherein carbon dioxide is used as refrigerant.

16. An evaporator for an air conditioning apparatus comprising:

a core portion having two groups of multiple vertically extending tubes, wherein the multiple tubes in each group are arranged in a line at generally equal intervals in a laminating direction;

an upper tank and a lower tank respectively provided at an upper end and a lower end of the multiple tubes, so that fluid passages formed in the tubes are communicated with inside spaces of the tanks, wherein the tanks are formed as separate parts from the tubes, and a width of the tanks is larger than that of the tubes in a direction perpendicular to a plane formed by the core portion;

fluid passage portions formed in the lower tank for respectively communicating the fluid passage of the tubes of one group with the fluid passage of the tubes of the other group, so that refrigerant flowing from the tubes of one group is respectively guided to the tubes of the other group, the lower tank defining a flange extending from the fluid passage portions in a direction in a direction generally perpendicular to the plane formed by the core portion; and multiple drainage means formed in the flange defined by the lower tank such that the drainage means do not interfere with the fluid passage portions.

17. An evaporator for an air conditioning apparatus comprising:

a core portion having multiple vertically extending tubes, which are arranged in a line at generally equal intervals in a laminating direction:

an upper tank and a lower tank respectively provided at an upper end and a lower end of the multiple tubes, so that fluid passages formed in the tubes are communicated with inside spaces of the tanks, wherein the tanks are formed as separate parts from the tubes, and a width of the tanks is larger than that of the tubes in a direction perpendicular to a plane formed by the core portion;

a fluid passage portion formed in the lower tank and extending in the laminating direction, wherein a width of the fluid passage portion is smaller than that of the tubes in the direction perpendicular to the plane formed by the core portion;

multiple fluid flow spaces formed in the lower tank and opposing to the respective ends of the tubes for communicating the fluid passages of the tubes with the fluid passage portion; and multiple drainage means formed at such portions of the lower tank, at which drainage means do not interfere with the fluid passage portion and the fluid flow spaces; wherein the lower tank comprises a tank plate at its upper side, to which lower ends of the tubes are fixed, and a tank element at its lower side connected to the tank plate to form inside space of the tank, and multiple claw portions are formed in one of the tank plate and the tank element at such portions, at which the drainage means are formed, wherein the claw portions are upwardly or downwardly bent to tightly fix the tank plate and the tank element with each other.

18. An evaporator according to claim 17, wherein notched portions are formed in the tank element at such portions, at which the drainage means are formed, and the claw portions respectively opposing to the notched portions are downwardly bent to tightly fix the tank plate and the tank element with each other.

19. An evaporator according to claim 17, wherein notched portions are formed in the tank plate at such portions, at which the drainage means are formed, and the claw portions respectively opposing to the notched portions are upwardly bent to tightly fix the tank plate and the tank element with each other.

* * * * *